United States Patent [19]

Kishimoto

[11] 4,451,132

[45] May 29, 1984

[54] COLOR PHOTOGRAPHIC PROCESSING APPARATUS INCLUDING A REVERSE OSMOSIS APPARATUS

[75] Inventor: Shinzo Kishimoto, Minami-ashigara, Japan

[73] Assignee: Fuji Photo Film Co., Ltd., Minami-ashigara, Japan

[21] Appl. No.: 450,278

[22] Filed: Dec. 16, 1982

[30] Foreign Application Priority Data

Dec. 17, 1981 [JP] Japan ..... 56-204726

[51] Int. Cl.[3] ..... G03D 3/06

[52] U.S. Cl. ..... 354/324; 430/398; 210/195.2; 210/321.1

[58] Field of Search ..... 354/320, 321, 322, 324; 430/398; 210/195.2, 321.1, 433.2, 651; 75/118 P

[56] References Cited

U.S. PATENT DOCUMENTS

| | | | |
|---|---|---|---|
| 3,042,520 | 7/1962 | Johnson . | |
| 3,241,966 | 3/1966 | Hellmann . | |
| 3,907,568 | 9/1975 | Shirasu et al. . | |
| 4,160,594 | 7/1979 | Geyken et al. | 354/324 |
| 4,265,431 | 5/1981 | Falomo . | |
| 4,343,892 | 8/1981 | Uenaka et al. . | |
| 4,346,980 | 8/1982 | Palazzolo | 354/324 |
| 4,367,941 | 1/1983 | Uenaka et al. | 354/324 |

FOREIGN PATENT DOCUMENTS

| | | |
|---|---|---|
| 5365732 | 11/1971 | Japan . |
| 1150466 | 4/1969 | United Kingdom . |
| 2062265 | 5/1981 | United Kingdom . |
| 701963 | 7/1979 | U.S.S.R. . |

OTHER PUBLICATIONS

Journal of Applied Photographic Engineering, vol. 5, No. 4, Fall 1979, (5:208–5:215, 5:216–5:219, (1979)).

Journal of Applied Photographic Engineering, vol. 5, No. 3, Summer 1979, (5:132–5:135 (1980), 5:141–5:143, (1979)).

Journal of Applied Photographic Engineering, vol. 2, No. 2, Spring 1976, (2:65–69, (1976)).

Journal of Applied Photographic Engineering (6:120–125, (1980)).

Kodak, "Silver Recovery with the Kodak Chemical Recovery Cartridge, Type P", publication No. J-9.

*Primary Examiner*—A. A. Mathews

*Attorney, Agent, or Firm*—Burns, Doane, Swecker and Mathis

[57] ABSTRACT

A color photographic processing apparatus including color developing, blixing and wash water tanks through which photographic materials are sequentially processed on passing the tanks comprises a reverse osmosis apparatus having a wash water inlet connected with the wash water tank, a condensed fluid outlet connected to said blixing tank and a diluted water outlet connected with said wash water tank.

12 Claims, 6 Drawing Figures

COLOR PHOTOGRAPHIC PROCESSING APPARATUS INCLUDING A REVERSE OSMOSIS APPARATUS

BACKGROUND OF THE INVENTION

The present invention relates to an apparatus for processing silver halide color photographic photo-sensitive material (hereinafter referred to "photographic material"), in particular, to a color photographic processing apparatus having a color developing tank, bleaching and fixing (hereinafter referred to "blixing") tank, and wash water tanks in which a reverse osmosis apparatus is provided for recovering the valuable ingredients in wash water and enabling significant saving of the wash water.

In the processing of photographic material, a pollution free process and saving the wash water by regenerating the processing fluids have recently been desired for the environmental protection and saving natural resource. Thus various researches and investigations have been carried out to meet such requirements.

For example, regeneration of color developing solutions has been put into practice by an electrodialysis process (J. Appl. Phot. Eng. 5, 208 (1979)) and an ion exchange process (J. Appl. Phot. Eng. 5, 132 and 216 (1979)).

Regeneration of blixing solutions has been put into practice by an ion exchange resin process (J. Appl. Phot. Eng. 2, 65 (1979)) and a steel wool process (Kodak Publication No. J-9) and a process in which a regeneration agent is added to an overflow solution so that it is reused as a replenishing solution as disclosed in U.S. Pat. No. 3,907,568 filed by the same assignee of the present invention.

In the regeneration of wash water, an ion exchange resin process was disclosed in J. Appl. Phot. Eng. 6, 120 (1980), and a process using reverse osmosis apparatus was disclosed in Soviet Union Pat. No. 701963. The both processes have not been put into practice yet from the view point of economy. Particularly, the latter process does not recover silver.

In recovery of silver carried over to wash water, there are known processes in which a wash water tank for the silver recovery is disposed between a silver containing tank and a wash water tank (U.S. Pat. Nos. 4,265,431 and 4,343,892 and U.K. Pat. No. 2,062,265). However, these processes have encountered such problems that the processing apparatus needs a complicated structure and occupies an increased area and that the control and maintenance of the wash water for the silver recovery is troublesome.

SUMMARY OF THE DISCLOSURE

It is, therefore, an object of the present invention to provide a novel color photographic processing apparatus.

It is another object of the present invention to provide a color photographic processing apparatus in which valuable ingredients in wash water can be recovered.

It is a further object of the present invention to provide a color photographic processing apparatus in which wash water can be reused to reduce replenishing wash water.

It is still a further object of the present invention to provide a color photographic processing apparatus which is economical and pollution-free.

In a color photographic processing apparatus including a color developing tank (or tanks), a blixing tank (or tanks) and a wash water tank (or tanks), through each tank (or tanks) photographic materials being sequentially processed on passing the same, those purposes hereinabove mentioned have been accomplished by the improvement according to the present invention, the improvement comprising:

a reverse osmosis apparatus having a wash water inlet connected with the wash water tank (or tanks), a condensed fluid outlet connected to said blixing tank (or tanks) and a diluted water outlet connected with said wash water tank (or tanks).

Through this arrangement, wash water overflowing from the wash water tank is processed through the reverse osmosis apparatus, the condensed fluid being returned to the blixing tank while the diluted water being returned to the wash water tank, respectively.

Each tank may be a single tank or composed of two or more tanks mutually connected and arranged consecutively.

DETAILED DESCRIPTION OF THE PREFERRED EMBODIMENTS

The color developing tank is usually provided with an overflow pipe, agitating means, solution temperature regulating means and means for supplying replenishing fluid or the like. A regenerating apparatus of the color developing solution may be connected with the tank to regenerate the developing solution for reuse.

The blixing tank subsequent to the color developing tank is filled with a blixing solution. The blixing solution comprises one or more bleaching agents which oxidize the metallic silver of a silver image and one or more fixing agents which dissolve both undeveloped silver halide and the silver halide formed by the oxidation of the developed silver by the bleaching agents.

The blixing tank is provided with an overflow pipe, agitating means, solution temperature regulating means and replenishing solution supplying means, and is communicated with the condensed solution outlet of the reverse osmosis apparatus. The overflow pipe is connected with a silver recovery apparatus in which the silver salts solved from the photographic materials is recovered from the blixing solution. The overflow pipe may be connected with an apparatus for regenerating the blixing solution if desired. The regenerated blixing solution is returned to the blixing tank by a suitable supplying means.

The blixing tank may be composed of two tanks mutually communicated, preferably, in a cascade manner. In this case, the overflow pipe is connected with the front tank (hereinafter, the term "front" means the side of the first processing tank, that is, the color developing tank, and the term "rear" means the side of the last processing tank, that is, the wash water tank), and the condensed fluid outlet of the reverse osmosis apparatus is connected with the rear tank or both tanks.

The wash water tank subsequent to the blixing tank is filled with wash water. Washing with water is done for completely removing the residual blixing solution from the photographic materials and thus to prevent the silver or color image resulting in the photographic materials from discoloration during prolonged storage.

The wash water tank may comprise a plurality of tanks which are consecutively connected, preferably, in a cascade manner. In this case, a rearmost tank (a tank through which the photographic material lastly pass) is preferably connected with a replenishing water supplying pipe. The front portion of the tank, i.e., a portion adjacent to the blixing tank, preferably, a frontmost tank is connected with a pipe introducing the overflow into the reverse osmosis apparatus. The rear portion of the wash water tank (i.e., portion most remote from the blixing tank), preferably, a tank arranged preceding the rearmost tank is connected with the deluted fluid outlet of the reverse osmosis apparatus through a pipe. In such an arrangement, the water in the wash water tank(s) will flow throughout the tanks from rear to front tanks so that the photographic materials will pass the tank in a countercurrent flow against the wash water flow resulting in increase in washing performance.

The reverse osmosis apparatus serves to separate the overflow containing the blixing solution from the wash water into a fluid containing the condensed blixing solution and diluted water based on the reverse osmosis. The reverse osmosis apparatus may comprise a commercially available sleeve, pleats, or spiral type module having a semipermeable membrane made of cellurose acetate, polyethylene or the like synthetic resin. Preferably, the area of the semipermeable membrane amounts to 0.5 to 2 $m^2$, and the approximate pressure of 10 to 100 $kg/cm^2$ is applied. Thus the wash water is supplied to the reverse osmosis apparatus under pressure.

In the aforementioned color photographic processing apparatus, photographic materials are sequentially passed through the color developing, blixing and washing tanks by means of a conveying apparatus so that they are subjected to each processing. The compositions of the processing solutions in each tanks encounter gradual change due to passing and processing of the photographic materials. For example, the color developing solution and thiosulfuric silver complex anions which have been dissolved from the photographic materials is carried over to the blixing solution in the blixing tank. The thus contaminated blixing solution is introduced into the silver recovery apparatus through an overflow pipe. If desired, a part of the blixing solution is introduced into the regenerating apparatus in which regenerating agents are added to the blixing solution. The regenerated blixing solution is returned to the blixing tank for reuse. The blixing solution may be replenished by such regenerated blixing solution as well as newly supplied blixing solution and the condensed fluid condensed by the reverse osmosis apparatus.

The silver-containing blixing solution is carried over to the wash water tank together with the photographic materials and contaminates the wash water on washing of the photographic materials with water.

The color developing solution filled in the color developing tank mainly comprises color developing main agents, preservative, penetrant and promoter. As the color developing main agents diethyl-para-phenylene diamine sulfate, 2-amino-5-diethyl aminotoluene chlorate, 4-amino-N-ethyl-N-(β-methane sulfone amidoethyl)-methatoluidine 3/2 sulfate monohydrate, 4-amino-N-ethyle-(β-hydroxyethyl)-3-toluidine sulfate monohydrate etc. may be used. As the preservative, penetrant for the protect coupler, and promoter an hydrous sodium sulfite, benzyl alcohol, and sodium hydroxide may be used, respectively.

As a fixing agent, thiosulfate and thiocyanate, as well as organic sulfur compounds known as having effects of the fixing agent may be used. A fixing solution may contain water-soluble aluminum salt as a hardening agent.

As a bleaching agent, compounds of multivalent metal such as iron (III), cobalt (III), chromium (VI) and copper (II), peracides, quinones, nitroso compounds or the like may be used. For instance, ferricyanides, bichromate, organic complexes of iron (III) or cobalt (III), amino-polycarboxylic acids such as ethylene diaminetetraacetic acid, nitrilotriacetic acid, 1.3-diamino-2-propanoltetraacetic acid, citric acid, tartaric acid, malic acid may be used. Among those, potassium ferricyanide, ethylenediamine iron(III) tetraacetate sodium, ethylenediamine iron(III) tetraacetate ammonium are particularly useful. An ethylenediamine iron(III) tetraacetate complex salt may be used in either a bleaching solution or a one-bath blixing solution.

The blixing solutions may be added with bleaching promoting agents as disclosed in U.S. Pat. Nos. 3,042,520 and 3,241,966 and Japanese Kokoku-Publications Nos. 45-8506 and 45-8836, and thiol compounds disclosed in Japanese Kokai laid open Publication No. 53-65732 as well as other various chemical additives.

The overflowing water containing the blixing solution is introduced from the wash water tank to the reverse osmosis apparatus in which the waste water is processed to separate into the condensed fluid containing condensed blixing solution and the diluted water containing less blixing solution.

Thus diluted water which has been cleaned by the reverse osmosis apparatus is returned to the wash water tank. The condensed fluid contains silver as well as blixing solution.

In accordance with the present invention, valuable ingredients such as silver and blixing solution may be recovered and the wash water is recycled. Namely, the amount of tap or replenishing wash water to the wash water tank is equivalent to that of the condensed fluid output from the reverse osmosis apparatus since the wash water is recycled through a substantially closed cycles composed of the wash water tank(s) and the reverse osmosis apparatus. Therefore the significant saving of wash water is possible.

The silver salt in blixing solution carried over to the wash water tank is returned to the blixing tank by the reverse osmosis apparatus. Accordingly, the silver recovery efficiency is increased without recourse to an additional silver recovery apparatus which recovers silver from the waste wash water.

The apparatus of the present invention can be applied to silver salt color photographic materials in general, such as color negative films, color positive films, color reversal cinne films, and color reversal TV films as well as color paper described in the following examples.

Therefore, the types of silver halide and protective colloids used in the color photographic photo-sensitive materials to be processed in the apparatus of this invention are not limited.

The advantages of the apparatus of the present invention will now be explained in detail referring to the following examples and drawings which serve to better illustration and not to limitation of the present invention.

EXAMPLES

Example 1

Figure 1:
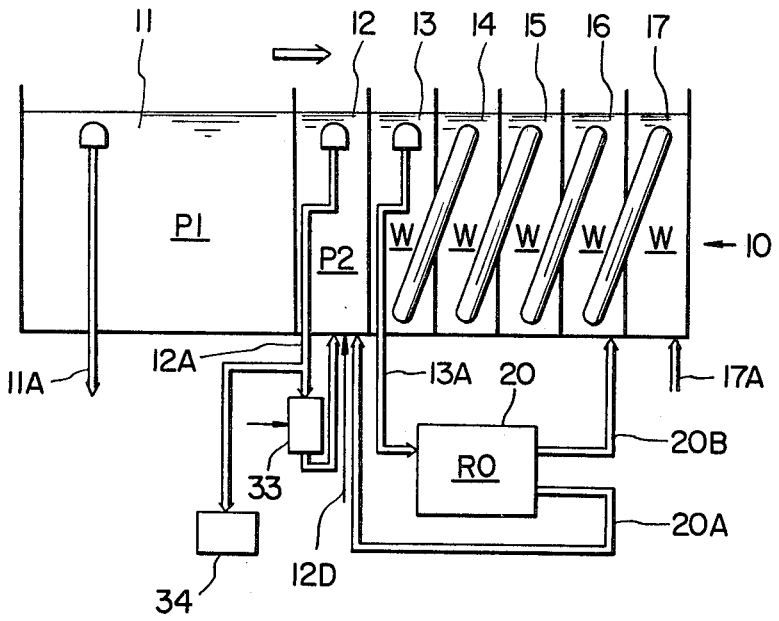
FIG. 1 is a schematic view showing an embodiment of a color photographic processing apparatus of the present invention.

A color photographic processing apparatus 10 comprises a color developing tank 11, blixing tank 12 and wash water tanks 13–17 which are consecutively arranged. The color developing tank 11 is provided with an overflow pipe 11A, agitating means (not shown), solution temperature regulating means (not shown) and blixing solution supplying means (not shown) and the like conventional means.

The color developing tank 11 is filled with 60 liters of a color developing solution having following composition:

benzyl alcohol: 10 ml
diethylene glycol: 3 ml
potassium carbonate: 25 g
sodium chloride: 0.1 g
sodium bromide: 0.5 g
anhydrous sodium sulfite: 2 g
hydroxylamine sulfate: 2 g
N-ethyl-N-$\beta$-methanesulfoneacidethyl-3-methyl-4-aminoaniline sulfate: 4 g The pH of the solution is adjusted to 10 by adding NaOH after water having been added to the above mixture to make up a total volume one liter.

A blixing tank 12 is further provided with, a replenishing solution supply means 12D, agitating means (not shown), and a temperature regulating means (not shown). The tank 12 is filled with 20 liters blixing solution which is maintained at 30°–34° C. The blixing solution has following composition:

ammonium thiosulfate (70 weight %): 150 ml
sodium sulfite: 10 g
$NaHSO_3$: 4 g
$EDTA.Fe.Na.2H_2O$: 50 g
EDTA: 5 g The pH of the solution is adjusted to 6.6 by adding NaOH after water has been added to the above mixture to make up a total volume one liter.

The water wash tanks 13 to 17 are seriesly connected each other. Each tank is filled with 20 liter water and maintained about 24° to 34° C.

The blixing tank 12 is provided with an overflow pipe 12A having a branched pipe connected to a recovery apparatus 33 for the blixing solution. The recovery apparatus is further connected to the tank 12 after a regenerating agent has been added to the blixing solution. Another branched pipe of the overflow pipe 12A is connected with a recovery apparatus 34 located outside the system.

A rearmost wash water tank 17 is connected with a water supply pipe 17A. A frontmost wash water tank 13 is connected with a reverse osmosis apparatus for introducing contaminated wash water thereto. A tank 16 is connected with the diluted water outlet of the reverse osmosis apparatus 20 through a pipe 20B.

The reverse osmosis apparatus is of a tublar type module manufactured by Paterson Candy International Ltd. including a semipermeable membrane made of cellulose acetate having a total area of 0.86 $m^2$ with the operating pressure of 40–50 $Kg/cm^2$.

A sheet of color paper manufactured by Fuji Photo Film Co. Ltd. Type 08 having 75% of unexposed area is passed in a direction indicated by an arrow in FIG. 1 subsequently through a color developing tank 11, blixing tank 12 and water wash tanks 13 to 17 in accordance with the steps as shown in Table 1 to evaluate the processed color paper. Each step requires a period of time as shown in Table 1. Per unit amount (8.25 cm×1 m) of the photographic material, the color developing tank 11 is supplied with 26.6 ml of replenishing solution. The tank 12 is supplied with 27 ml of regenerated blixing solution. Tank 17 is supplied with 40 ml of water through the pipe 17A. Waste wash water is introduced to the reverse osmosis apparatus through the pipe 13A at a rate of 72 ml/8.25 cm×1 m. The condensed solution is discharged from the outlet pipe 20A at a rate of 15 ml/8.25 cm×1 m and the diluted water is discharged from the outlet pipe 20B at a rate of 58 ml/8.25 cm×1 m.

TABLE 1

| steps | symbol | temperature | time |
|---|---|---|---|
| color developing | P 1 | 33.0 ± 0.3 | 3' 30" |
| blixing | P 2 | 30–34 | 1' 30" |
| water washing | W | 24–34 | 3' 30" |
| drying | — | 80 ± 5 | — |

': min
": sec

TABLE 2

| steps | symbol | temperature | time |
|---|---|---|---|
| color developing | P 1 | 33.0 ± 0.3 | 3' 30" |
| blixing | P 2 | 30–34 | 1' 30" |
| rinsing | P R | 15–34 | 1' 00" |
| water washing | W | 24–34 | 2' 30" |
| drying | — | 80 ± 5 | — |

': min
": sec

The results of the photographic material processed under the abovementioned conditions will be described hereinafter in comparison with those of the Comparative test 1.

Comparative Test 1

Figure 2:
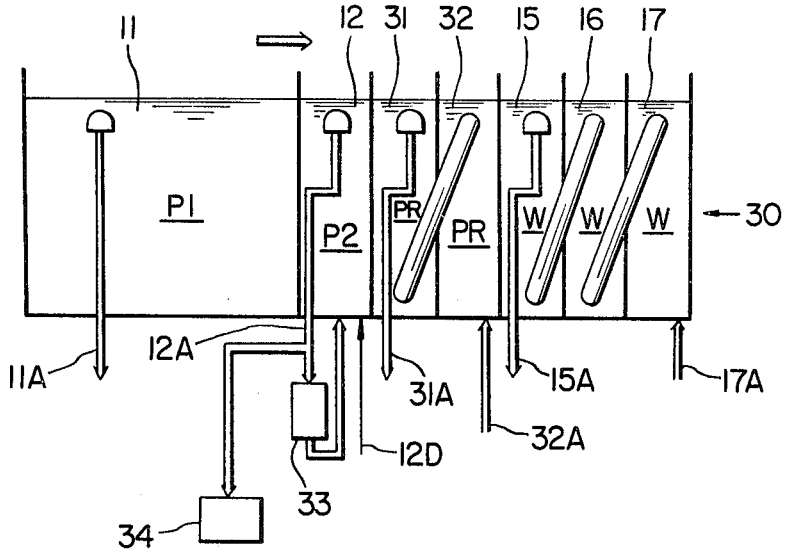
FIG. 2 (PRIOR ART)
FIGS. 2 and 4 are schematic views showing color photographic processing apparatus used for reference test.

An apparatus 30 shown in FIG. 2 includes a silver recovery water wash tank as disclosed in U.S. Pat. No. 4,343,892 and is different from the apparatus 10 of Example 1 in that the reverse osmosis apparatus 20 is omitted from the processing apparatus 10 of the Example 1 and a communication pipe between the second and third tanks 14 and 15 are removed and the tanks 13 and 14 are used as silver recovery tanks 31 and 32, wherein the second tank (water wash tank) 32 for silver recovery is provided with a water supply pipe 32A. Processing solutions having compositions similar to those of solutions used in Example 1 is used in corresponding tanks.

A unit amount (8.25 cm×1 m) of photographic material is processed in the comparative apparatus in accordance with the steps shown in Table 2. The blixing procedure is operated substantially in the same manner as in Example 1. The amount of wash water supplied through the pipe 31A from the silver recovery wash water tank 31 is 14 ml. The amount of the water supplied to the wash water tanks through pipes 32A and 17A are 14 ml and 400 ml, respectively, making a total amount of supplied water 414 ml.

Following results are obtained under the abovementioned conditions.

(1) Time for removal of silver in blixing tank (the time is defined as that required for all silver in the photographic material to dissolve in blixing process)

The apparatus of Example 1 requires 50 to 55 seconds whereas the comparative apparatus requires 60 to 65 seconds. Accordingly the time for silver removal is diminished by 9 to 30% by returning the blixing solution recovered from the reverse osmosis apparatus 20 to the blixing tank.

(2) Recovery rate of silver

Comparative apparatus exhibits about 98% of silver recovery rate. This means that it is impossible to recover the remaining about 2% silver contained in voluminous waste washing water. In contrast thereto, more than 99.9% recovery of silver is possible in the Example 1 apparatus because the amount of the wash water discarded from the apparatus is substantially zero. Substantially 100% recovery is possible because about 0.1% loss of silver occurs merely during the silver recovery procedure.

(3) Quality of the processed color paper

The color paper processed by the Example 1 apparatus exhibits less contamination at the cut edge of the paper caused by impregnation of processing solutions. It may be well thought this is due to the fact that the content of the color developing solution in the blixing tank is relatively lowered by the recovered blixing solution. The stability at storage, i.e., fastness properties to light (e.g., fading) of the color paper processed by the exemplary apparatus is substantially equivalent to those by the comparative apparatus although the amount of the wash water supplied to the washing water tank is about 1/10 of that supplied to the comparative apparatus. Accordingly, significant saving of water is accomplished.

Example 2

An apparatus of this example carries out a non-recovery processing (so called "NR processing" of Eastman Kodak) while the apparatus of above both examples recover the overflow from the blixing tank by adding recover agents so that recovered solution is reused.

Figure 3:
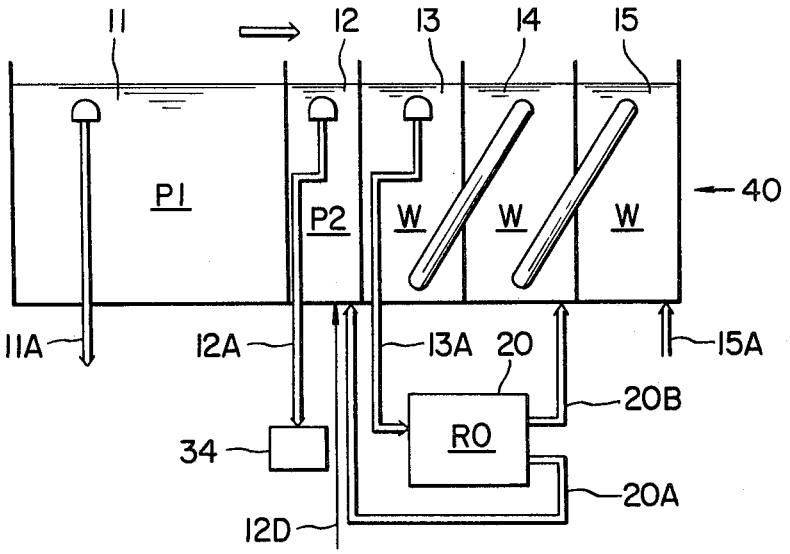
FIGS. 3, 5 and 6 are schematic views showing modified embodiments of the present invention.

As is shown in FIG. 3, a color paper processing apparatus 40 comprises a color developing tank 11, blixing tank 12, wash water tanks 13 to 15 and a reverse osmosis apparatus 20. The apparatus of the Example 2 is identical with that of Example 1 except that the apparatus of Example 2 includes no means for recovering the blixing solution. In Example 2, all the overflow from the blixing tank is consumed for recovery of valuable ingredients and the new blixing solution is replenished through a pipe 12D.

The color developing tank 11, blixing tank 12 and reverse osmosis apparatus 40 shown in FIG. 3 are identical with those shown in FIG. 1, respectively. The wash water tanks 13 to 15 in FIG. 3 consecutively connected are substantially identical with the wash water tanks 13 to 17 of FIG. 1 in the structure. Processing solutions in each tanks, the processed photographic paper and the processing steps in Example 2 are identical with Example 1.

The water-replenishing rate to the water tank 17 through a pipe 15A is 40 ml/8.25 cm×1 m. Substantially the same processing is carried out in the reverse osmosis apparatus as in Example 1.

Comparative Test 2

Figure 4:
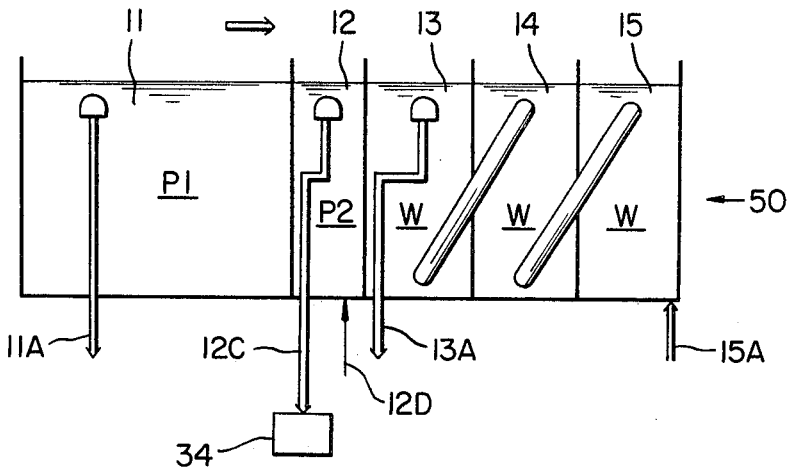

An apparatus 50 of the Comparative test 2 as shown in FIG. 4 is identical with that of Example 2 as shown in FIG. 3 except that the reverse osmosis apparatus 20 is removed. Processed color paper and the processing solutions in each tanks are identical with those of Example 2. The processing steps are shown in Table 2. The rate of the water supplied to the wash water tank 15A is 800 ml/8.25 cm×1 m. The rate of the blixing solution supplied to the blixing tank 12 is 4.8 ml/8.25 cm×1 m.

Results of Example 2 and Comparative test 2 are as follows:

(1) Stability of blixing solution

Comparative apparatus has an inevitable problem that the process in the blixing tank is readily influenced by the carry over of the color developing solution of a preceding step since only a very small amount of the blixing solution is replenished to the blixing tank. It is difficult for a squeegee at the exit of the developing tank to regulate the amount of the color developing solution carried over into the blixing tank. In contrast thereto, the exemplary apparatus makes it possible to suppress the influence of the carry over of the developing solution upon the blixing solution since an increased amount of the blixing solution recovered through the reverse osmosis apparatus is returned to the blixing tank resulting in an improved stability of the blixing solution.

(2) Quality of the processed color paper

Comparison of processed color papers reveals that the fastness of the processed color paper of the Example 2 is substantially equivalent to that of the Comparative test 2 although the amount of the replenishing water of the Example 2 is about 1/20 of that of the Comparative test 2. Significant saving of the replenishing water is thus attained.

Example 3

Figure 5:
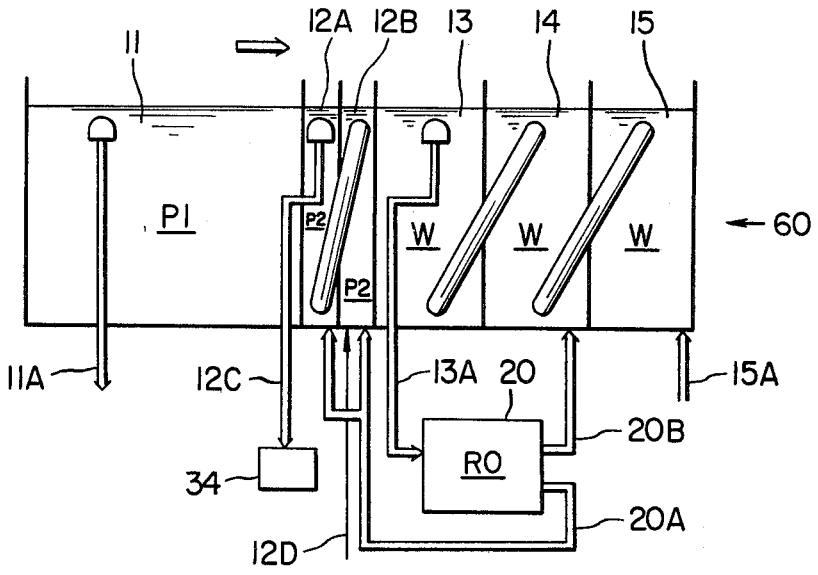
Figure 6:
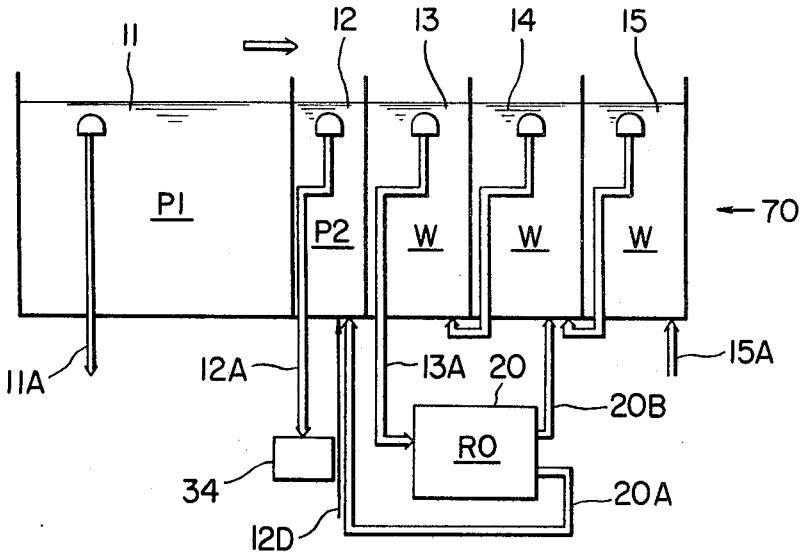

A photographic processing apparatus 60 as shown in FIG. 5 is identical with the apparatus except that the blixing tank includes two tanks 12A and 12B connected each other in a cascaded manner. Each tank is filled with 10 l of blixing solution. The blixing solution recovered by the reverse osmosis apparatus 20 is returned to blixing tanks 12A and 12B each at an equal rate (20 ml/8.25 cm×1 m). Further replenishing blixing solution is supplied to the blixing tank 12B through a pipe 15A at a rate of 40 ml/8.25 cm×1 m. The resultant color paper has an excellent fastness and exhibits less contamination caused by residual color developing solution. The rate of silver recovery attained in the apparatus shown in FIGS. 3 and 5 is not less than 99.9% while the rate of silver recovery attained in the apparatus shown in FIG. 4 amounts to about 60%.

Example 4

A color photographic processing apparatus 70 is identical with the apparatus 60 shown in FIG. 5 except that three water washing tanks 13 to 15 are connected by pipes in a cascade manner so that a counterflow is formed against the movement of the photographic materials. The flow pattern of the wash water is substantially countercurrent as a whole as well as countercurrent in each wash water tanks. The photographic materials processed by the apparatus 70 exhibit an excellent fastness and the recovery rate of silver is not less than 99.9%.

What is claimed is:

1. A color photographic processing apparatus including color developing tank or tanks, blixing tank or tanks and wash water tank or tanks through which photographic materials are sequentially processed on passing the tanks, wherein the improvement comprises a reverse osmosis apparatus having a wash water inlet connected with the wash water tank(s), a condensed fluid outlet connected to said blixing tank(s) and a diluted water outlet connected with said wash water tank(s).

2. The apparatus as defined in claim 1, in which the wash water substantially in a countercurrent flows against a photographic material through the wash water tank(s).

3. The apparatus as defined in claim 2, in which the inlet of the reverse osmosis apparatus is connected with the front side of the wash water tank and the diluted water outlet of the reverse osmosis apparatus is connected with the rear side of the wash water tank.

4. The apparatus as defined in claim 2 or 3, in which a pipe for replenishing water is provided at the rearmost side of the wash water tank.

5. The apparatus as defined in claim 2, in which the wash water tank includes a plurality of tanks consecutively connected.

6. The apparatus as defined in claim 5, in which a frontmost wash water tank is connected with the inlet of the reverse osmosis apparatus and a rearmost tank is connected with a water replenishing pipe and a tank preceding the rearmost tank is connected with the diluted water outlet of the reverse osmosis apparatus.

7. The apparatus as defined in claim 1, in which the blixing tank comprises a plurality of cascade-connected tanks.

8. The apparatus as defined in claim 7, in which two or more blixing tanks are connected with the condensed fluid outlet of the reverse osmosis apparatus.

9. The apparatus as defined in claim 1 or 7, in which said condensed fluid outlet is connected to the rear side of the blixing tank.

10. The apparatus as defined in claim 1 or 7, in which the wash water flows in a countercurrent against the photographic material in each wash water tanks.

11. The apparatus as defined in claim 1, in which the blixing tank is connected with a regenerating apparatus of the blixing solution.

12. The apparatus as defined in claim 1 or 11, in which the blixing tank is connected to a recovery means for recovering silver and blixing agents.

* * * * *